US007896482B2

(12) United States Patent
Rodriguez et al.

(10) Patent No.: US 7,896,482 B2
(45) **Date of Patent: *Mar. 1, 2011**

(54) INK STICK WITH ELECTRONICALLY-READABLE MEMORY DEVICE

(75) Inventors: Alberto Rodriguez, Webster, NY (US); Heiko Rommelmann, Penfield, NY (US); Will Phipps, Fairport, NY (US); Scott J. Bell, Rochester, NY (US); Jerry Money, Rochester, NY (US); David Rocco Arden Campbell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/574,004

(22) Filed: Oct. 6, 2009

(65) Prior Publication Data

US 2010/0020147 A1 Jan. 28, 2010

Related U.S. Application Data

(62) Division of application No. 11/317,976, filed on Dec. 23, 2005, now Pat. No. 7,618,138.

(51) Int. Cl.
*B41J 2/175* (2006.01)

(52) U.S. Cl. ..... 347/88; 347/99; 347/103

(58) Field of Classification Search ..... 347/88, 347/99, 103

See application file for complete search history.

(56) References Cited

U.S. PATENT DOCUMENTS 5,861,903 A * 1/1999 Crawford et al. ..... 347/88
6,016,409 A * 1/2000 Beard et al. ..... 399/33

* cited by examiner

*Primary Examiner*—Manish S Shah
(74) *Attorney, Agent, or Firm*—Wiggin and Dana LLP

(57) ABSTRACT

A machine, such as a phase change or solid ink printing apparatus, includes at least one ink stick and a coupler external to the ink stick. The ink stick has an electronically-readable memory device attached thereto, with the memory device having stored therein electronic data associated with the ink stick. The coupler is configured to read the electronic data from the memory device. The data in the memory device may include identification data, anti-arbitrage variables, usage data, maximum use values, and performance data related to the ink stick, and the coupler and memory device may employ various means for communicating this data. Also, communication between the coupler and memory device facilitates a method for determining a quantity of marking material in the machine.

8 Claims, 9 Drawing Sheets

INK STICK WITH ELECTRONICALLY-READABLE MEMORY DEVICE

CROSS-REFERENCE TO RELATED APPLICATIONS

This is a divisional application of U.S. application Ser. No. 11/317,976, filed Dec. 23, 2005.

BACKGROUND

Certain printing machines receive marking material in a form known as an ink stick. The ink stick is a solid or semi-solid structure formed from the marking material, wherein the structure is wholly or partially consumed in the printing process. Unlike powdered or liquid marking materials, ink sticks can be handled and installed without a bottle, cartridge, or other container. Ink sticks may be of any convenient shape (e.g., a pellet, block, brick, cube, or any other geometric structure) for handling and loading into the printing apparatus.

For example, one printing apparatus that uses ink sticks is known as a phase change or solid ink printer. In phase change printers, a feed mechanism delivers the ink stick to a heater assembly, where the ink is melted into a liquid state for depositing onto a receiving medium. U.S. Pat. No. 5,734,402 for an "Ink Feed System", issued Mar. 31, 1998 to Rousseau et al.; and U.S. Pat. No. 5,861,903 for an "Ink Feed System", issued Jan. 19, 1999 to Crawford et al., which are incorporated by reference herein in their entirety, describe exemplary systems for delivering ink sticks into a phase change printer.

Ink sticks hold their shape and, therefore, may be handled and loaded into the printing apparatus without the need for a container or cartridge, as is typically required for liquid ink or powdered toner. Furthermore, the entire ink stick may be melted and consumed, with no need to dispose of, or recycle, any container. Eliminating the need for a container provides many advantages to the use of ink sticks. However, without the use of a container, there are no mechanisms for authenticating or otherwise identifying the ink stick.

A common trend in the office equipment industry is to provide expendable supply units (e.g., copier and printer toner bottles, cartridges, and the like), also known as customer replaceable units (CRUs) or modules, with electronically-readable memory devices, also known as customer replaceable unit monitors (CRUMs), which, when the module is installed in the machine, enable the machine to both read information from the CRUM and also write information to the CRUM. The information read from, or written to, the CRUM may be used by the machine to perform various functions, such as verifying the authenticity of the module, providing operational set points to the machine, and others. For example, U.S. Pat. No. 6,016,409 entitled "System For Managing User Modules in a Digital Printing Apparatus", which is incorporated by reference herein in its entirety, describes various data that may be stored in a CRUM and various functions that may be performed using this data.

BRIEF SUMMARY

In one aspect, there is provided an ink stick having an electronically-readable memory device attached thereto. The memory device has stored therein electronic data associated with the ink stick.

In another aspect, there is provided a method for determining a quantity of a marking material in a machine, wherein the marking material is in the form of ink sticks arranged in a queue, and each of the ink sticks has an electronically-readable memory device attached thereto. The method comprises: a) identifying a lead ink stick in the queue; b) interrogating the memory device attached to each of the ink sticks in the queue to determine a number of ink sticks in the queue; c) determining at least one of a remaining quantity of the lead ink stick and a consumed quantity of the lead ink stick; and d) determining the quantity of the marking material in the machine using the number of ink sticks in the queue and the at least one of the remaining quantity of the lead ink stick and the consumed quantity of the lead ink stick.

In yet another aspect, there is provided a method of identifying an ink stick. The method comprises: attaching an electronically-readable memory device to the ink stick; and storing electronic data in the memory device, the electronic data identifying the ink stick.

In yet another aspect, there is provided a method of manufacturing an ink stick. The method comprises attaching an electronically-readable memory device to the ink stick, wherein the memory device has stored therein electronic data related to the ink stick.

In yet another aspect, there is provided a machine comprising at least one ink stick and a coupler external to the ink stick. The ink stick has an electronically-readable memory device attached thereto, with the memory device having stored therein electronic data associated with the ink stick. The coupler is configured to read the electronic data from the memory device.

BRIEF DESCRIPTION OF THE DRAWING

Referring now to the figures, which are exemplary embodiments, wherein like items are numbered alike.

DETAILED DESCRIPTION

Figure 1:
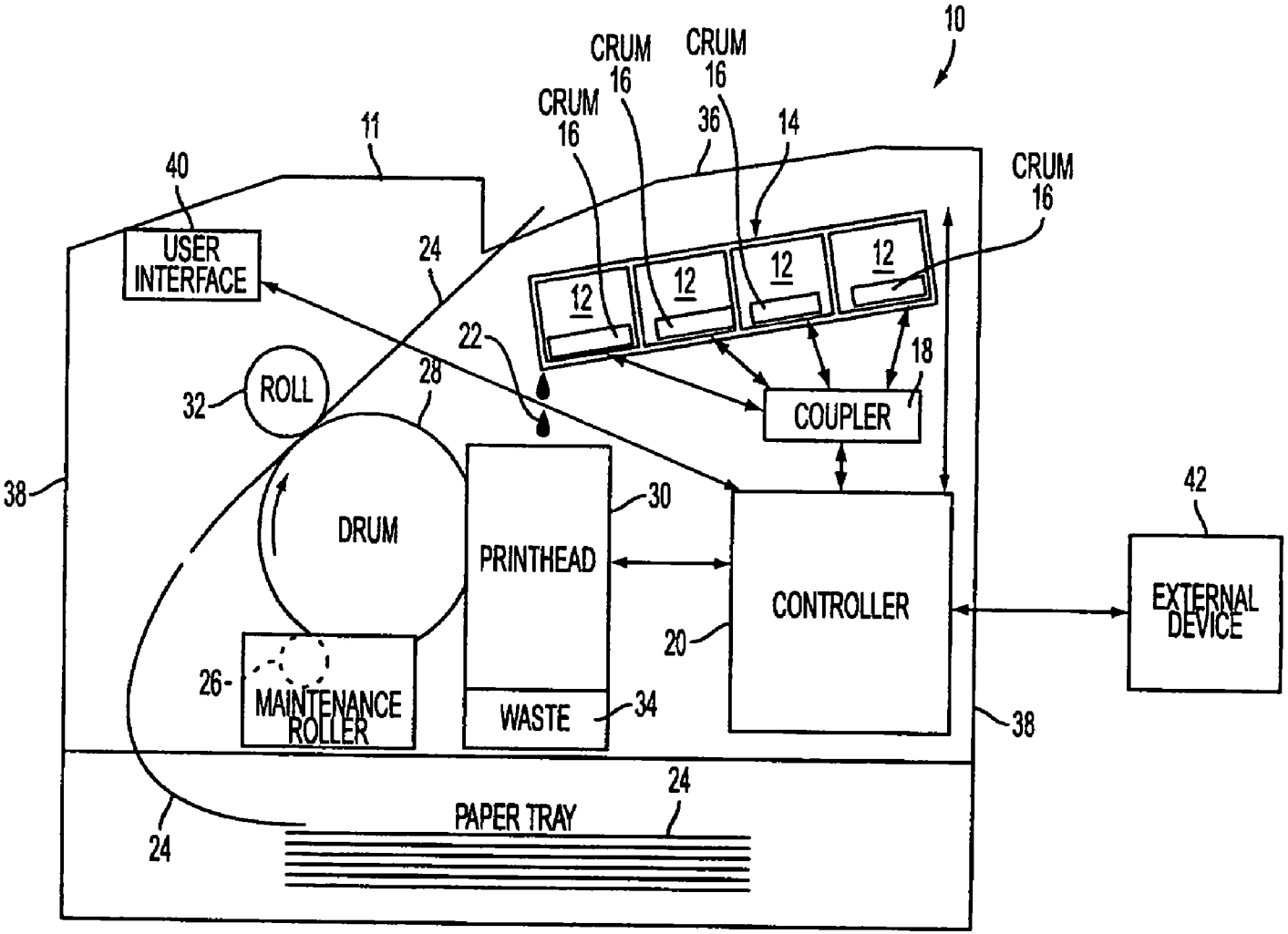
FIG. 1 is a schematic elevation view of a printing apparatus including ink sticks, wherein each of the ink sticks includes an electronically-readable memory device.

FIG. 1 is a schematic elevation view of a machine 10 including ink sticks 12 loaded in a solid ink feed system 14 of the printing apparatus, wherein each of the ink sticks 12 includes an electronically-readable memory device 16, also known as a customer replaceable unit monitor or CRUM. Each CRUM 16 retains data relevant to the identification, function, and performance of the respective ink stick 12. Because it includes a non-volatile memory, each CRUM 16 can act as a "scratch pad" for retaining the data stored therein, which travels with the ink sticks 12, even when the ink sticks 12 are not installed in the machine 10.

The machine 10 further includes a coupler 18, for communicating electronic data between the CRUMs 16 and a controller 20. As will be described in further detail hereinafter, this data may include identification data, anti-arbitrage variables, usage data, maximum use values, and performance data related to the ink stick 12, and the coupler 18 and CRUMs 16 may employ various means for communicating this data. Also, communication between the coupler 18 and CRUMs 16 facilitates a method for determining a quantity of marking material in the machine 10.

As used herein, a "coupler" is any physical component of the machine 10 that includes circuitry for communicating data to and/or from one or more CRUMs 16. For example, the coupler 18 may include a printed circuit board, a housing, a platform, or the like, which supports microprocessors, application-specific integrated circuits (ASICS), electronic circuitry, or the like, through which data are communicated to and/or from the CRUMs 16. As will be discussed hereinafter, the coupler 18 may include components of a radio frequency identification (RFID) reader (also known as an interrogator or transceiver). While shown as separate components, it is contemplated that the controller 20 and the coupler board 18 may be a single component (e.g., a single printed circuit board).

As used herein, an "ink stick" includes any solid or semi-solid (e.g., gel) structure formed from a marking material for use in a printing apparatus, wherein the structure is wholly or partially consumed in the printing process. Unlike powdered or liquid marking materials, the ink sticks can be handled and installed without a bottle, cartridge, or other container. The ink stick may be of any convenient shape (e.g., a pellet, block, brick, cube, or any other geometric structure).

In FIG. 1, the machine 10 is depicted as a printing apparatus 10, and more particularly as a phase change printing apparatus, wherein the ink sticks 12 are melted into a liquid state 22 for depositing onto a receiving medium 24 (e.g., paper, transparencies, plastic, or any other material). It is contemplated, however, that the machine 10 may be any machine in which ink sticks 12 are installed.

In the phase change printing apparatus of FIG. 1, the printing process begins with a maintenance roller 26 applying a microscopic layer of silicone oil to a heated drum 28 to facilitate ink release from the drum 28. Melted ink 22 from the feed system 14 flows into an ink reservoir in a printhead 30. Next, the printhead 30 applies the ink onto the rotating drum 28. A receiving medium 24 is fed between the drum 28 and a transfix roller 32, transferring the ink to the receiving medium 24. The ink on the receiving medium 24 cools and solidifies, forming a permanent bond to the receiving medium 24. Waste ink from the printhead 30 is collected in a waste container 34, which may be cleaned or replaced by the user. The operation of the printing apparatus is further described in U.S. Pat. No. 5,805,191, entitled "Surface Application System", to Jones et al, and U.S. Pat. No. 5,455,604, entitled "Ink Jet Printer Architecture and Method", to Adams et al, which are incorporated by reference herein in their entirety.

The machine 10 includes an outer housing 11 having a top surface 36 and side surfaces 38. A user interface 40, such as a front panel display screen, displays information concerning the status of the machine 10, and user instructions. The user interface 40 may also include buttons or other control elements (not shown) for controlling operation of the machine 10. The user interface 40 communicates electronic data with the controller 20, which generally controls the operation of the machine 10. In addition, controller 20 may communicate through a network connection, such as over phone lines or the Internet, to a device 42 external to the machine 10. The controller 20 may include one or more microprocessors, application-specific integrated circuits (ASICs), or other signal processing devices encoded with instructions to operate the machine 10.

Figure 2:
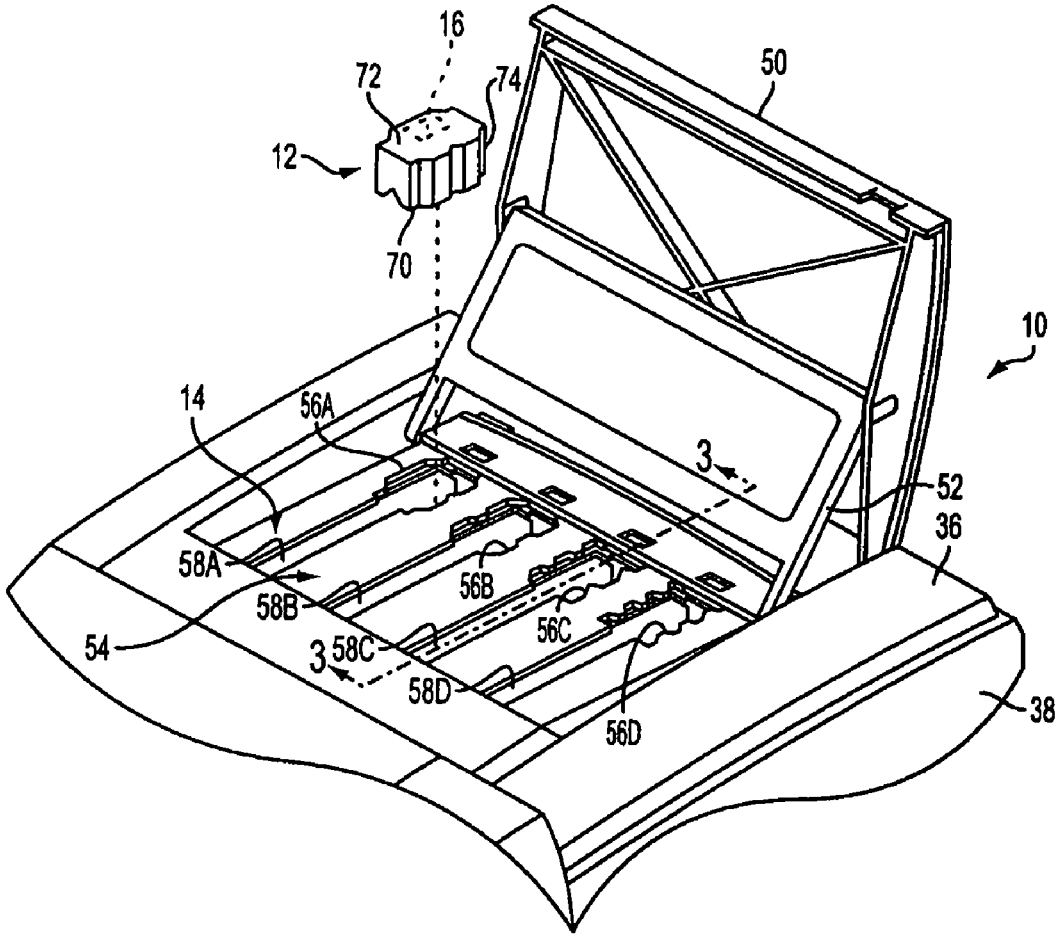
FIG. 2 is an enlarged partial top perspective view of the printing apparatus with an ink access cover open, showing an ink stick in position to be loaded into a feed channel.

Referring to FIG. 2, the top surface 36 of the housing includes a hinged ink access cover 50 that opens to provide the user access to the solid ink feed system 14. In the particular example shown, the ink access cover 50 is attached to an ink load linkage element 52 so that when the ink access cover 50 is raised, the ink load linkage 52 slides and pivots to an ink load position. The interaction of the ink access cover 50 and the ink load linkage 52 may be as described in U.S. Pat. No. 5,861,903 for an "Ink Feed System", issued Jan. 19, 1999 to Crawford et al. As seen in FIG. 2, opening the ink access cover 50 reveals a key plate 54 having keyed openings 56A-D. Each keyed opening 56A, 56B, 56C, 56D provides access to an insertion end of one of several individual longitudinal feed channels 58A, 58B, 58C, 58D of the solid or semi-solid ink feed system 14.

Figure 3:
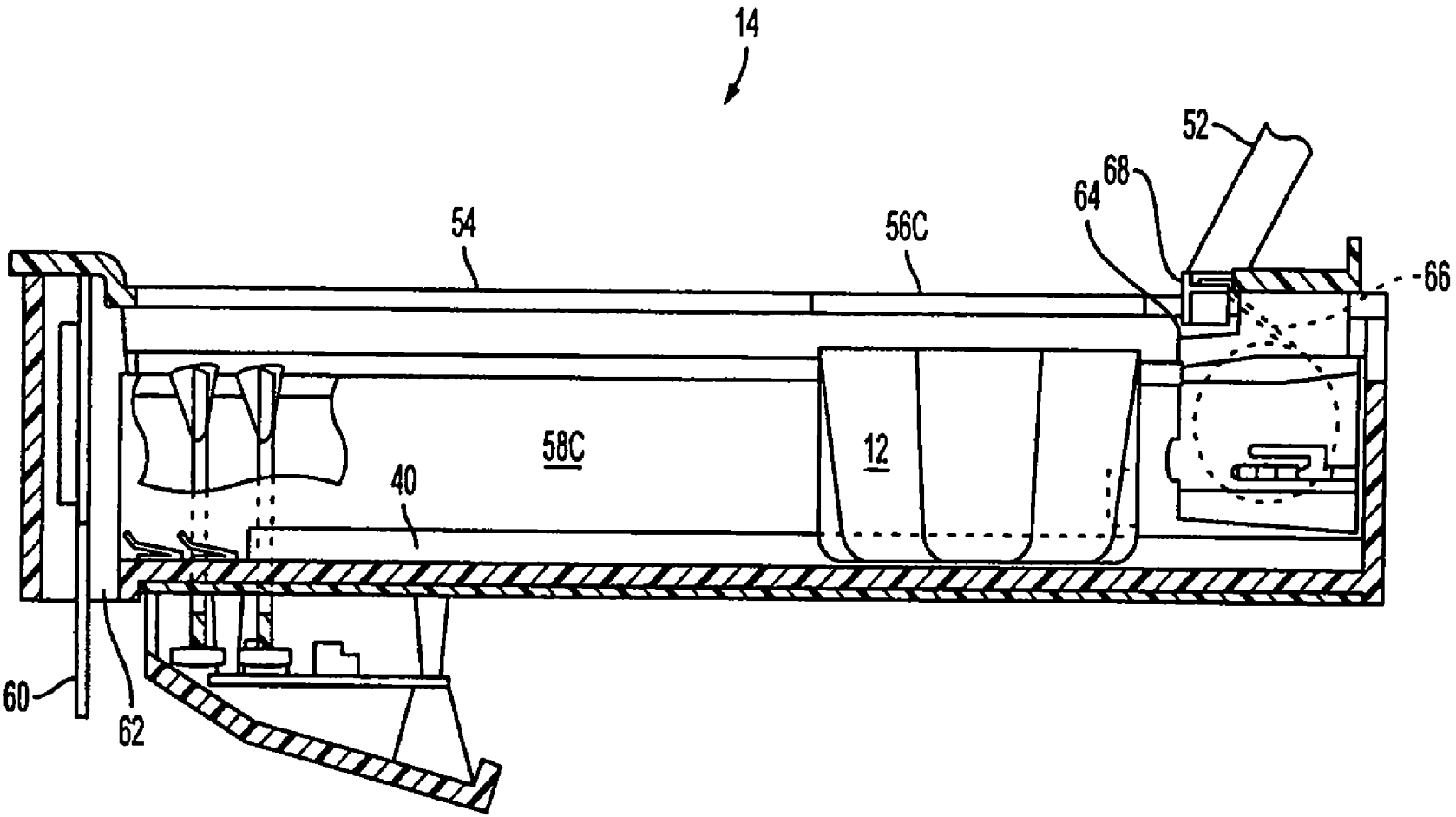
FIG. 3 is a side sectional view of a feed channel of a ink feed system taken along line 3-3 of FIG. 2.

Referring to FIGS. 2 and 3, each longitudinal feed channel 58A-D delivers ink sticks 12 of one particular color to a corresponding melt plate 60. Each feed channel 58 has a longitudinal feed direction from the insertion end of the feed channel 58 to the melt end of the feed channel 58. The melt end of the feed channel 58 is adjacent the melt plate 60. The melt plate 60 melts the ink stick 12 into a liquid form as at 22. The melted ink drips through a gap 62 between the melt end of the feed channel 58 and the melt plate 60, and into the liquid ink reservoir in the printhead 30 (FIG. 1). The feed channels 58A-D have a longitudinal dimension from the insertion end to the melt end, and a lateral dimension, substantially perpendicular to the longitudinal dimension. Each feed channel 58 in the particular embodiment illustrated may include a push block 64, which may be driven by a driving force or element, such as a constant force spring 66, to push the individual ink sticks 12 along the length of the longitudinal feed channel 58 toward the melt plate 60. The tension of the constant force spring 66 drives the push block 64 toward the melt end of the feed channel. As described in U.S. Pat. No. 5,861,903, the ink load linkage 52 is coupled to a yoke 68, which is attached to the constant force spring 66 mounted in the push block 64. The attachment to the ink load linkage 52 pulls the push block 64 toward the insertion end of the feed channel 58 when the ink access cover 50 (FIG. 2) is raised to reveal the key plate 54. In lieu of the push block 64 and spring 66, the feed system 14 may rely on gravity to move the ink sticks 12 to the melt plate 60.

Referring again to FIG. 2, a color printer typically uses four colors of ink (yellow, cyan, magenta, and black). Ink sticks 12 of each color are delivered through a corresponding individual one of the feed channels 58A-D. The operator of the printer exercises care to avoid inserting ink sticks 12 of one color into a feed channel 58 for a different color. Ink sticks 12 may be so saturated with color dye that it may be difficult for a printer user to tell by color alone which color is which. Cyan, magenta, and black ink sticks in particular can be difficult to distinguish visually based on color appearance. The key plate 54 has keyed openings 56A, 56B, 56C, 56D to aid the printer user in ensuring that only ink sticks 12 of the proper color are inserted into each feed channel 58. Each keyed opening 56A, 56B, 56C, 56D of the key plate 54 has a different and unique shape. The ink sticks 12 of the color for that feed channel 58A-D have a shape corresponding to the shape of the respective keyed opening 56A-D. The keyed openings and corresponding ink stick shapes exclude from each ink feed channel ink sticks of all colors except the ink sticks of the proper color for that feed channel.

FIG. 2 depicts an exemplary ink stick 12, which is formed of an ink stick body having a bottom, represented by a general bottom surface 70, a top, represented by a general top surface 72, and at least two lateral extremities or sides, represented by general side surfaces 74. As noted above, the side surfaces 74 may also be shaped with the key shapes to match the keyed openings 56 through the key plate 54. It will be appreciated, however, that the ink stick 12 may be of any convenient geometric shape. The ink stick 12 may be formed by pour molding, compression molding, or other formation techniques, and the marking material used to form the ink stick 12 may be any marking material for use in a printing apparatus. Attached to the ink stick 12 is the CRUM 16.

Figure 4:
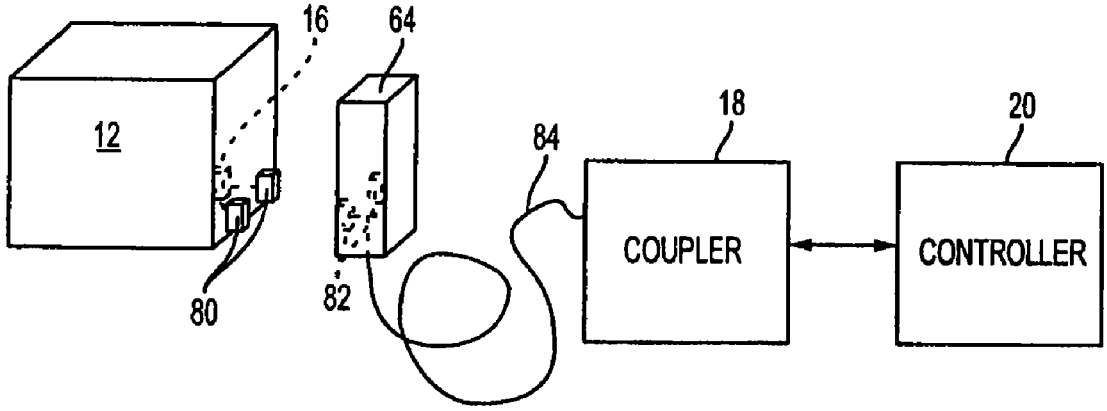
FIG. 4 is a simplified schematic view of one means for communicating the electronic data between the memory device and a coupler in the machine.

FIG. 4 is a simplified schematic view of one means for communicating electronic data between the CRUM 16 and the coupler 18. In the example of FIG. 4, the CRUM 16 includes a non-volatile memory device (e.g., an electrically erasable programmable read-only-memory (EEPROM), flash memory, or the like) electrically connected to at least one contact pad 80 disposed on a surface of the ink stick 12. When the ink stick 12 is loaded into the feed system 14 of the machine 10, one or more corresponding contact pads 82 disposed in the machine 10 make electrical connection with one or more of the pads 80 on the CRUM 16. For example, the pads 82 may be disposed on the push block 64 of the feed system 14 such that the pads 82 make electrical connection with the pads 80 on the ink stick 12 as the push block 64 pushes the ink stick 12 toward the melt plate 60 (FIG. 3). With electrical connection between the pads 80 and 82 made, the coupler 18 can read the electronic data from the CRUM 16 and/or write electronic data to the CRUM 16. The coupler 18 may be connected to the pads 82 on the push block 64 via conductors 84 or, as will be discussed in further detail hereinafter, via wireless means.

In FIG. 4, and in various other Figures herein, the ink stick 12 is illustrated as a block to simplify the illustrations. It will be appreciated, however, that the ink stick 12 may be of any convenient geometric shape.

Figure 5:
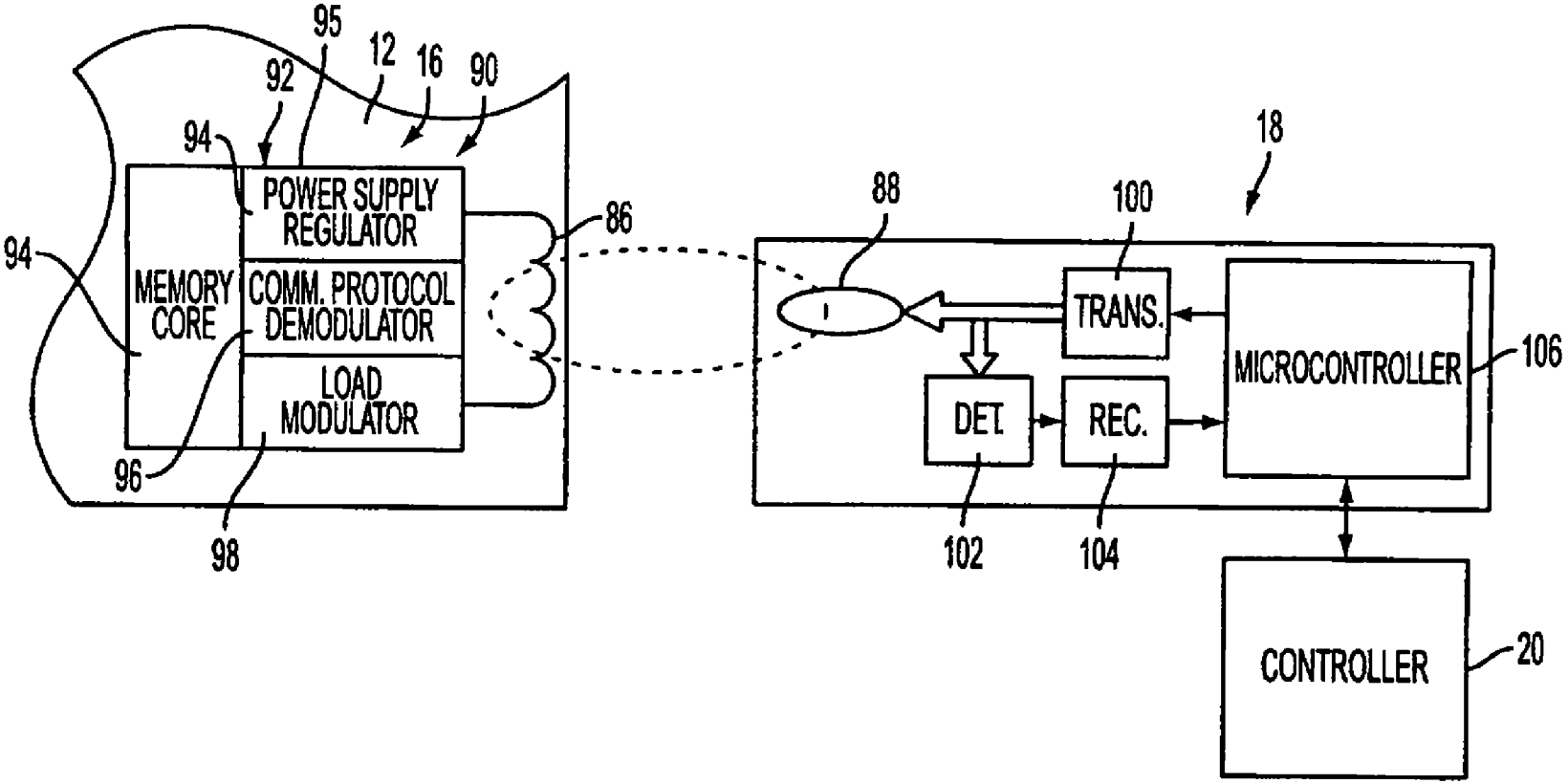
FIG. 5 is a simplified schematic view of another means for communicating the electronic data between the memory device and the coupler.

FIG. 5 is a simplified schematic view of another means for communicating electronic data between the CRUM 16 and the coupler 18. In the embodiment shown, the CRUM 16 is in the form of a passive radio-frequency identification (RFID) tag 90 that communicates data by way of electric and/or magnetic field coupling between an antenna 86 forming part of the tag 90 and an antenna 88 on the coupler 18. The coupler 18 acts as an RFID reader (also known as an interrogator or transceiver).

Within tag 90, data storage and processing as well as radio frequency (RF) communications functions are typically performed by an integrated circuit chip 92, also known as a radio frequency identification chip. For example, the chip 92 may include: a memory core 94 (e.g., an EEPROM or flash memory), which stores the data associated with the CRUM 16; a power supply regulator 95, which rectifies and otherwise conditions alternating current induced in the antenna 86 by a time-varying RF signal provided by the antenna 88 on the coupler 18 for use in the tag 90 as a direct current power source; and receiver/emitter modules 96, 98 (e.g., compatible with the ISO 14443 standard) for demodulating and decoding incoming data from the received RF signal and superimposing outgoing data on the RF carrier signal by load variation, respectively.

The coupler 18 includes a transmitter 100 that generates the time-varying RF signal transmitted by the antenna 88. As a result of electromagnetic coupling between the tag antenna 86 and the coupler antenna 88, a portion of the RF signal transmitted by the tag antenna 86 enters the coupler antenna 88 and is separated from the transmitted signal by a detector 102 (e.g., an envelope detector). The separated signal is passed to a receiver 104, where it is amplified, decoded and presented via a microcontroller 106 to the controller 20.

The coupler antenna 88 may be sized and positioned within the machine 10 such that it communicates with one or more CRUMs 16. Where the printing apparatus uses more than one color ink stick 12 and, therefore, more than one feed channel 58 (FIG. 2), the coupler 18 may include one antenna 88 per channel. Alternatively, a single antenna 88 may be used to read the CRUMs 16 from all ink sticks 12 installed in the printing apparatus. Similarly, the coupler 18 may be configured to communicate with one ink stick 12 per channel 58 (e.g., when the ink sticks are first installed), or the coupler 18 may be configured to communicate with each ink stick 12 in the channel 58.

Where more than one ink stick 12 is read together in the same RF field, the coupler 18 and tags 90 may employ an anti-collision technique, which allows the coupler 18 to receive data from each tag 90 on a one-by-one basis. Any convenient anti-collision technique may be employed. For example, a so-called "gap pulse" technique may be used wherein, in response to the receiver 104 detecting signal collision from competing tags 90, the microcontroller 106 causes the transmitter 100 to transmit a gap pulse via antenna 88. When each tag 90 recognizes the gap pulse, it ceases further transmission of data until it counts a randomly generated number. Each tag 90 will finish counting the number in a different time and, as a result, will transmit its data at a different time.

Figure 6:
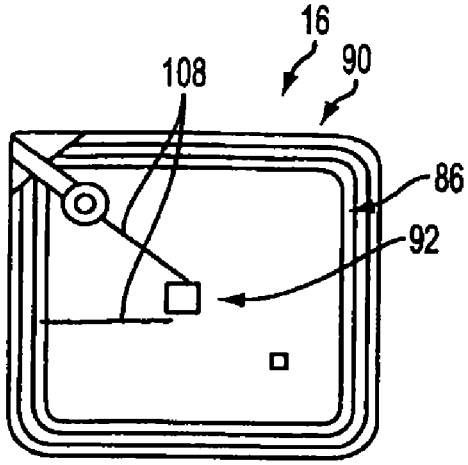
FIG. 6 is a plan view of a radio frequency identification tag that may be used in the embodiment of FIG. 5.
Figure 7:
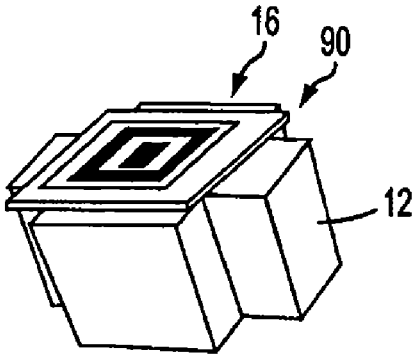
FIG. 7 is a perspective view of the radio frequency identification tag of FIG. 6 attached to an ink stick.

FIG. 6 depicts an example of an RFID tag 90 that may be used as a CRUM 16 in the embodiment of FIG. 5, and FIG. 7 depicts the RFID tag 90 of FIG. 6 attached to an ink stick 12. The tag 90 may be adhered to the surface of the ink stick 12, or may be at least partially embedded in the ink stick 12. In the tag 90, the RFID chip 92 receives power, ground, and signaling from two leads 108, which are coupled to the antenna 86. As depicted in FIG. 6 and FIG. 7, the antenna 86 is typically large in relation to the RFID chip 92, which makes the CRUM 16 large in relation to the ink stick 12.

Referring to FIGS. 1 and 7, because the ink stick 12 is consumed during the printing process, minimizing the size of the CRUM 16 in relation to the size of the ink stick 12 is desirable to facilitate disposal of the CRUM 16 after the ink stick 12 has been consumed. More specifically, if a large CRUM 16 is used, disposal of the CRUM 16 within the machine 10 is more problematic than if a small CRUM 16 is used because a small CRUM 16 will take up less space as waste and can be more easily manipulated for disposal within the machine 10. For example, a small CRUM 16 may be disposed of along with waste ink using gravity or a vacuum to move the CRUM 16 along with the waste ink from the reservoir in the printhead 30 to the waste container 34, while a larger tag may require a relatively complex system to dispose of the tag once the ink stick is consumed. Therefore, to reduce the size of the CRUM 16, an RFID chip 92 having an integrated antenna, as shown in FIG. 8, may be used.

Figure 8:
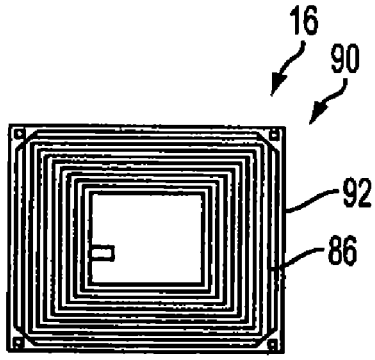
FIG. 8 is a plan view of an alternative radio frequency identification tag that may be used in the embodiment of FIG. 5.
Figure 9:
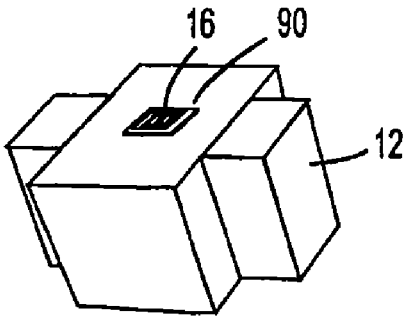
FIG. 9 is a perspective view of the radio frequency identification tag of FIG. 8 attached to an ink stick.

Referring to FIG. 8, in the example shown, the antenna 86 is part of the same chip 92 that performs the data storage, processing, and radio frequency (RF) communications functions described with reference to FIG. 5. The chip of FIG. 8 employs capacitive coupling of the output signal of the coupler 18 directly to the RF input stage (e.g., the communications protocol demodulator 96) of the RFID chip 92. One example of such a chip is commercially available from Hitachi Maxwell, Ltd. of Tokyo, Japan as model number ME-Y1001. FIG. 9 depicts the RFID chip 92 attached to an ink stick 12. The chip 92 may be adhered to the surface of the ink stick 12, or may be at least partially embedded within the ink stick. Comparison of FIGS. 7 and 9 show that the tag 92 is substantially smaller than the tag 90 of FIG. 7.

Figure 10:
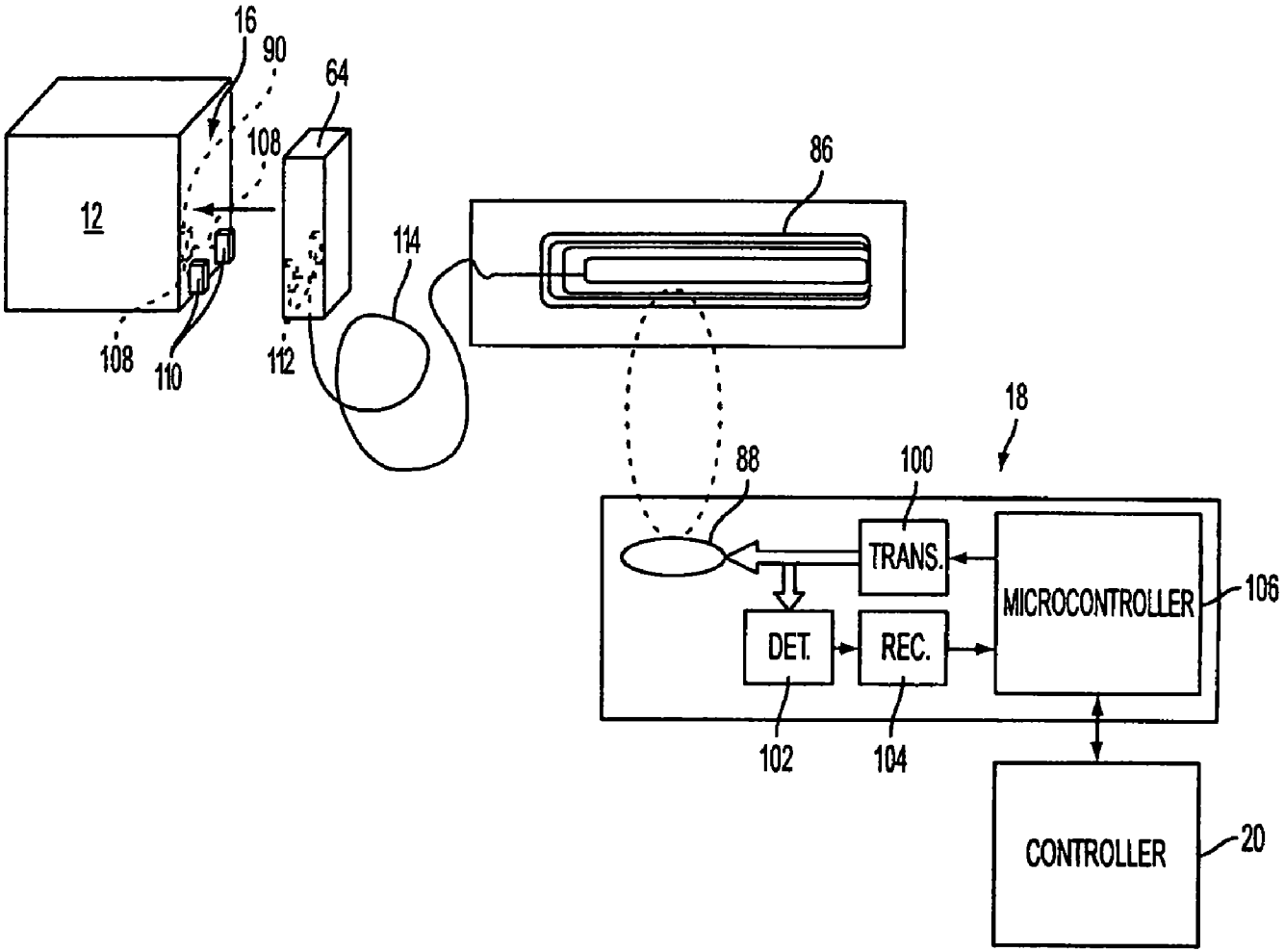
FIG. 10 is a simplified schematic view of yet another means for communicating the electronic data between the memory device and the coupler

Another means to reduce the size of the CRUM 16 is shown in FIG. 10, wherein the antenna 86 is located in the machine 10 external to the ink stick 12. In the embodiment of FIG. 10, the ink stick 12 includes at least one contact pad 110 disposed on a surface of the ink stick 12 for communicating the electronic data between the RFID chip 90 and an antenna 86 external to the ink stick 12. The RFID chip 90 receives power, ground, and signaling from the two leads 108, which are coupled to the antenna 86 by way of the contact pads 110. The pads 110 may be positioned on the top, bottom, or side surfaces of the ink stick 12, with mating contact pads 112 disposed at a corresponding position within the machine 10. In the example shown, the pads 112 are disposed on the push block 64 of the feed system 14 such that the pads 112 on the push block 64 make electrical connection with the pads 110 on the ink stick 12 as the push block 64 pushes the ink stick 12 toward the melt plate 60 (FIG. 2). The antenna 86 may be connected to the pads 112 on the push block 64 via a conductor 114 of sufficient length to allow travel of the push block 64. Alternatively, the antenna 86 may be positioned on the push block 64. It is contemplated that the antenna 86 could be mounted anywhere in the machine 10, with the machine side contacts 112 being positioned near the ink sticks 12.

In the embodiment of FIG. 10, the RFID chip 90, contact pads 110, and conductors 108 form a "stub", which may be embedded into the ink stick 12 such that only a portion of the pads 110 are exposed. It is contemplated that the stub may have features such as tabs, spikes, tie bars, and surface irregularities that help to retain the stub within the ink stick 12. The marking material forming the ink stick 12 may be capable of acting as an adhesive to retain the stub within the stick 12. Advantageously, the stub may be small in size (e.g., 6-10 millimeters at its greatest dimension), which facilitates disposal of the stub within the machine 10.

Referring again to FIG. 1, there are many different types of data which could be stored in CRUM 16. In a broad sense, the CRUM 16 could retain an identifier for the ink stick 12, such as a serial number, which can be used by the machine 10 to determine, for example, whether the particular installed ink stick 12 is compatible with the machine 10. For color machines having different feed channels for each color, the identification could be used by the machine 10 to determine if the ink stick 12 is installed in the correct channel (e.g., black ink sticks are installed in the black channel, cyan ink sticks are installed in the cyan channel, etc.). The controller 20 can output an error code to the user interface 40 if it is determined that an ink stick 12 has been incorrectly installed.

In addition, the data stored in the CRUM 16 may include one or more anti-arbitrage variables. As used herein, an "anti-arbitrage variable" is any data that can be used to identify a market in which the ink stick 12 is authorized by the manufacturer to be sold and/or used, or, conversely, any data that can be used to identify a market in which the ink stick is unauthorized for sale and/or use. Such data can be provided to the controller 20, via the coupler 18, which will prevent the use of an ink stick 12 if it is determined that the market in which the ink stick is intended for use does not match a market associated with the machine 10. Such data can also be read by a reader external to the machine 10 (e.g., during shipping or storage of the ink stick) to prevent the sale, resale, and/or use of the ink stick 12 in an unauthorized market. For example, the anti-arbitrage variables may include a market region code that identifies the market region, such as a geographical region, in which the ink stick 12 is authorized to be sold and/or used. In another example, the anti-arbitrage variables may include a field of use code that identifies a particular field of use arrangement existing between the manufacturer and the seller or user of the ink stick 12 that limits the sale or use of the ink stick 12. The field of use code may indicate, for example, that the ink stick 12 is to be sold only as part of a package or that the ink stick 12 is to be used only for certain machines.

In other types of CRUM systems, the CRUM 16 can maintain data related to use of the ink stick 12. For example, the CRUM 16 may include a print count indicating the number of prints which have been output using the particular ink stick 12. In another example, the CRUM 16 may include a pixel count that represents the total cumulative usage of the particular ink stick 12 in terms of the number of pixels which have been printed using the ink stick 12. Of course, in a color-capable printing apparatus, the pixel usage would be determined with respect to each different color pixel generated by the machine 10. U.S. Pat. No. 5,636,032, incorporated by reference herein, gives a general teaching of pixel-counting techniques useful for determining a consumption rate of marking material. Other data related to the use of the ink stick 12 may be related to a temperature of the melt plate 60 (FIG. 3) and/or a duration which the melt plate 60 is energized to melt the ink stick 12.

The CRUM 16 may also include data indicating a maximum use value. The maximum use value is a value, typically entered into a predetermined location in the CRUM memory at manufacture of the ink stick, which indicates the maximum usage (e.g., maximum number of prints or maximum number of pixels) for which the particular ink stick is designed to output before replacement. This maximum use value will of course be compared with the current print count or pixel count, and when the print or pixel count reaches a certain range relative to the maximum value, the controller 20 can display a particular message on the user interface 40 and/or place a "reorder" notice over the network or phone line to the manufacturer or supplier, indicating that ink sticks 12 will soon need to be installed and/or ordered.

Another type of data which may be stored in a particular location in the non-volatile memory of the CRUM 16 may relate to specific performance data associated with the ink stick 12, so that the ink stick 12 can be used in an optimal, or at least advisable, manner. For instance, in the ink jet context, it is known to load data symbolic of optimal voltage or pulse width in the CRUM 16, so that the printhead 30 may be optimally operated when the ink stick 12 is installed. In another example, the CRUM 16 may include data relating to temperatures at which the melt plate 60 (FIG. 3) is to be heated for melting the ink stick 12. Again, there may be provided any number of spaces in the of the CRUM 16 memory for retaining information relating to different performance data.

Figure 11:
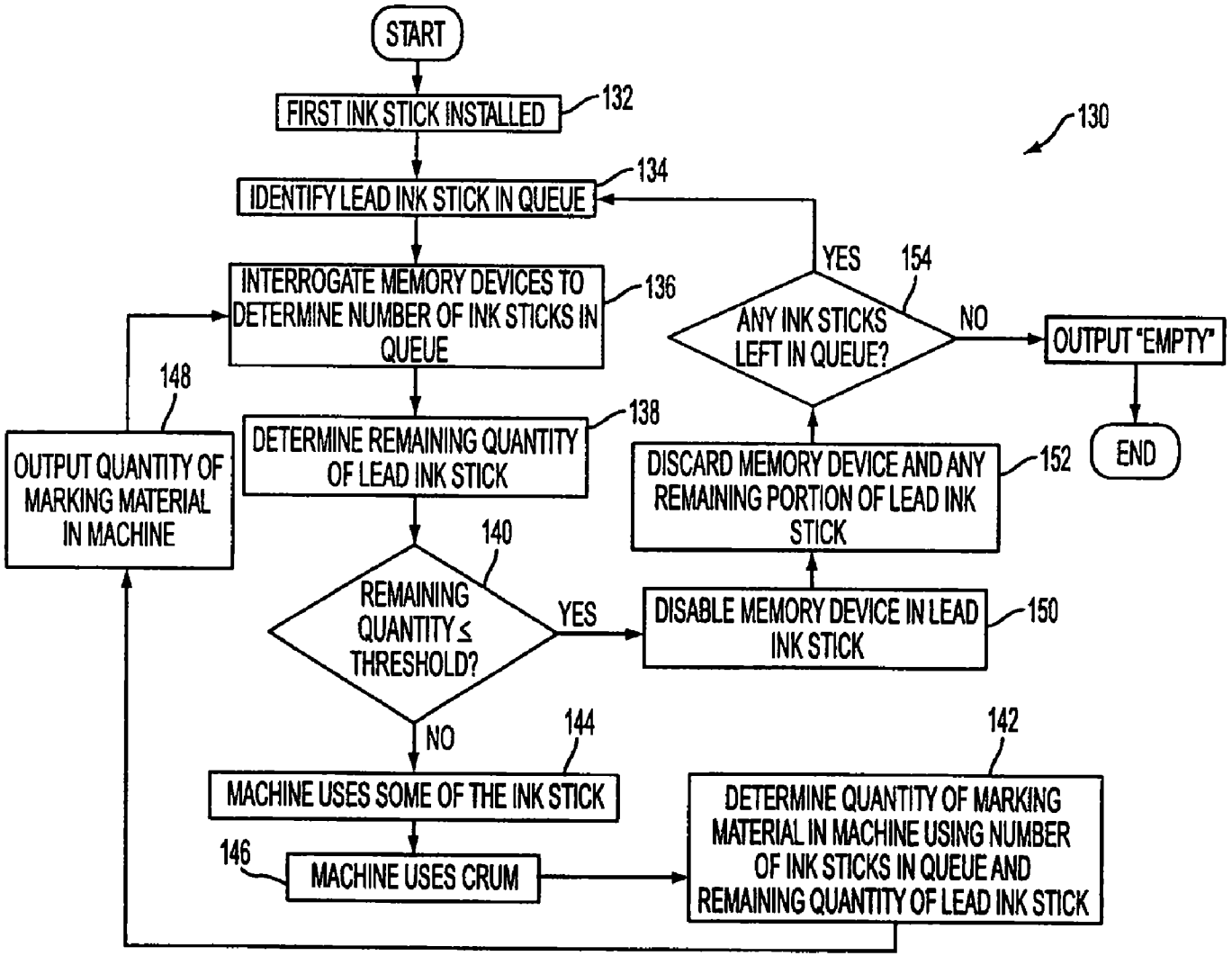
FIG. 11 is a flow chart depicting a method for determining a quantity of marking material in the machine.

The CRUMs 16 may also be useful in determining a capacity of marking material in the machine 10. For example, FIG. 11 is a flow chart depicting a method 130 for determining a quantity of marking material in the machine 10, and FIGS. 12A-D depict ink sticks 12 queued in a feed channel 58 of the machine 10 during various steps of the method 130. The method 130 of FIG. 11 is described for a single feed channel 58; however, for color machines having more than one feed channel 58, the method 130 may be employed for each feed channel 58 to determine the quantity of marking material of each color.

Figure 12D:
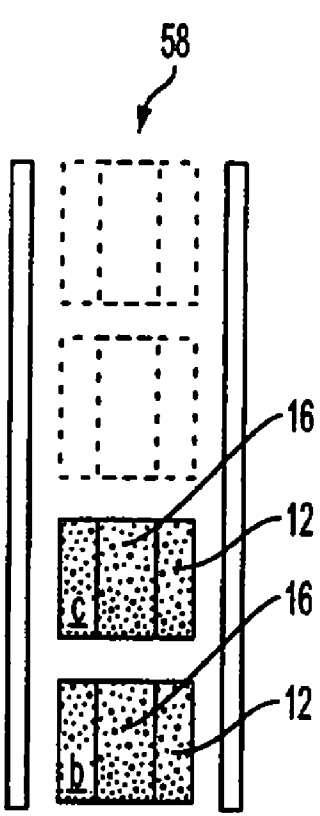
FIGS. 12A-D depict ink sticks in a feed channel of the printing apparatus during various steps of the method of FIG. 11.
Figure 12C:
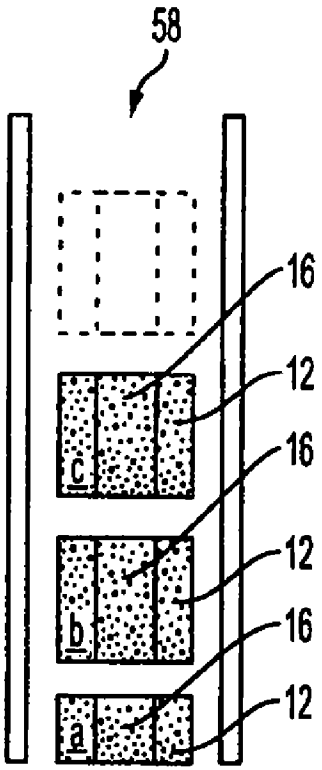

Referring to FIGS. 1, 9, and 11, method 130 begins with the installation of the first ink stick 12 into the feed channel 58 of the machine 10 (block 132). Next, the coupler 18 will communicate with the CRUM 16 in the first ink stick 12 to identify the ink stick 12 as the lead ink stick (i.e., the ink stick in the queue to be consumed), as indicated at block 134. This may be performed by writing to the CRUM 16 a unique variable (e.g., binary code) specifying the lead ink stick. Also, the coupler 18 may communicate with the CRUM 16 in the first stick 12 to read identification data, anti-arbitrage variables, usage data, maximum use values, and performance data, as discussed above. FIG. 12A indicates the lead ink stick 12 as "a" in the channel 58.

Figure 12B:
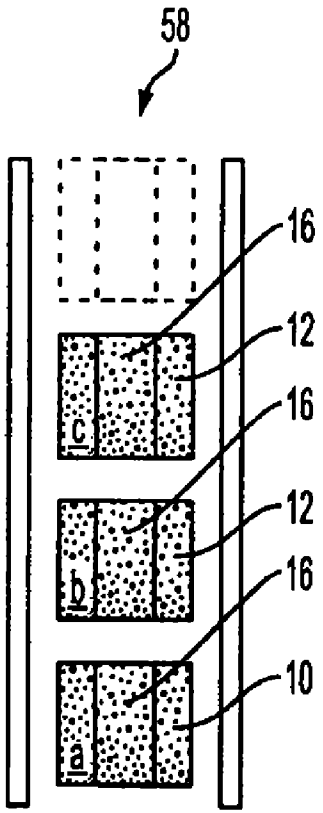
Figure 12A:
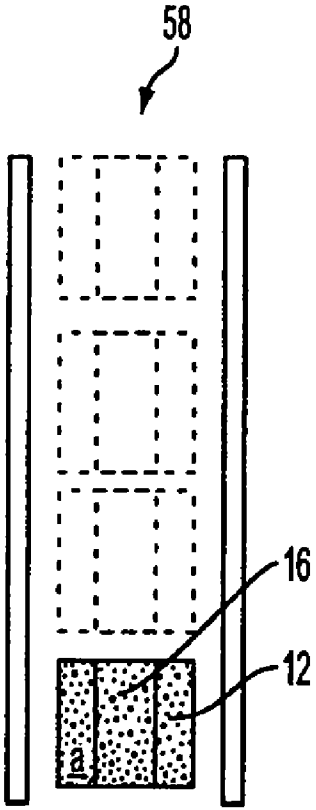

After the lead ink stick 12 is installed, the user may choose to install additional ink sticks 12 to the queue of ink sticks in the channel 58, as depicted in FIG. 12B. In FIG. 12B, ink stick "a" is the lead ink stick 12, ink stick "b" is the second ink stick 12, and ink stick "c" is the third ink stick 12 in the queue. Upon installation of each additional ink stick 12, the coupler 18 may communicate with the CRUM 16 in the additional ink stick 12 to read identification data, anti-arbitrage variables, usage data, maximum use values, and performance data, as discussed above. It is contemplated that additional ink sticks 12 may be added at any time during the process.

Method 130 continues at block 136, where the coupler 18 interrogates the CRUMs 16 in each of the ink sticks 12 to determine the number of ink sticks 12 in the queue. For example, this may be done by transmitting a signal, which sets off a unique response from each of the CRUMs 16, and the number of unique responses are used by the controller 20 to determine the number of ink sticks 12.

Next, in block 138, controller 20 determines the remaining quantity (or consumed quantity) of the lead ink stick 12. The controller 20 may determine this data by keeping track of usage data for the lead ink stick 12 since the time the lead ink stick 12 was identified in block 134. As previously noted, data related to use of the ink stick 12 may include such data as page count or pixel count, and/or melt plate temperature/usage.

If, in block 140, the controller 20 determines that the remaining quantity (or consumed quantity) of the lead ink stick 12 is greater than (or less than) a predetermined threshold, the method continues to block 142, where the controller 20 determines the total quantity of marking material in the queue. The predetermined threshold may be, for example, the aforementioned maximum use values associated with the ink stick 12. As previously noted, a maximum use value is a number that indicates the maximum usage (e.g., maximum number of prints or maximum number of pixels) for which the particular ink stick 12 is designed to output before replacement.

In block 142, the total quantity of marking material in the machine may be determined as a sum of the remaining quantity of the lead ink stick 12 and the quantities of the unused ink sticks 12 in the queue. For example, in FIG. 12B, given that three ink sticks 12 are installed, no prints have been made (i.e., the lead ink stick is whole), and the maximum number of ink sticks 12 that may be installed in the channel 58 is four, the total quantity of marking material in the queue is 75% full (a=25%, b=25%, and c=25%). As prints are made, the lead ink stick 12 (stick "a") is consumed as depicted at block 144 and as shown in FIG. 12C and the machine updates the CRUMs 16 regarding the amount of ink used as indicated at block 146. If the controller 20 determines that half of the lead ink stick 12 has been consumed, the total quantity of marking material in the queue is then determined to be 62.5% full (a=12.5%, b=25%, and c=25%).

The quantity of marking material in the machine may be output to the user interface, as shown in block 148, and the process continues at block 136, where the CRUMs 16 are again interrogated to determine the number of ink sticks 12 in the queue. The interrogation of the CRUMs 16 at block 136 may be performed periodically by the controller 20, or may be performed in conjunction with a print request.

If, at block 140, the controller 20 determines that the remaining quantity (or consumed quantity) of the lead ink stick 12 is less than or equal to (or greater than or equal to) a predetermined threshold, the method 130 continues to block 150, where the controller 20 communicates with the CRUM 16 in the lead stick 12, via the coupler 18, to disable the CRUM 16 in the lead stick 12, thereby preventing reuse of the CRUM 16 in another ink stick. This step may be performed by writing an identifier to the CRUM 16, or erasing an existing identifier in the CRUM 16.

After the CRUM 16 is disabled, method 130 continues at block 152, where the CRUM 16 and any remaining portion of the lead stick 12, are discarded. Next, in block 154, the controller 20 determines if there are any ink sticks 12 left in the queue. This may be accomplished using data from the previous interrogation of the queue, or by performing a new interrogation of the queue. If there are ink sticks remaining in the queue, as shown in FIG. 12D, the method continues to block 134, where the controller 20 identifies the new lead ink stick in the queue. For example, as shown in FIG. 12D, ink stick "b" is the new lead ink stick in the queue. The coupler 18 may communicate with the CRUM 16 in the new lead ink stick 12 to identify it as the lead ink stick. The method then continues at block 136.

The new lead ink stick may be identified in any one of several different ways. For example, each stick's CRUM could be serialized as part of the manufacturing process (or as part of the initial machine insertion sequence). This would allow all of the CRUMs to be tracked when in the machine through use of this assigned serial number. Or, once a stick becomes the lead stick in a machine, that CRUM can be marked in a given memory location (one bit is sufficient) as having been "Used At Least Once" as still another way 3). When the CRUM from a used-up lead ink stick is discarded the machine's serial number can be written to the CRUM's memory. On terrogation the fact that the machine's serial number does or doesn't exist in the CRUM being interrogated would indicate that it is or isn't the lead CRUM, respectively.

If, at block 154, it is determined that there are no ink sticks 12 remaining in the queue, the controller 20 may cause an "empty" indication to appear on the user interface 40. The method 130 then ends, and will restart again upon the installation of another ink stick 12.

The method 130 of FIG. 11 may be implemented as software executed by the controller 20. Such software can be a computer program product which employs a storage medium including stored computer code which is used to program the controller 20 to perform the disclosed functions and processes. The storage medium may include, but is not limited to, any type of conventional floppy disks, optical disks, CD- ROMs, magneto-optical disks, ROMs, RAMs, EPROMs, EEPROMs, magnetic or optical cards, or any other suitable media for storing electronic instructions.

It should be understood that any of the features, characteristics, alternatives or modifications described regarding a particular embodiment herein may also be applied, used, or incorporated with any other embodiment described herein.

A number of embodiments have been described. Nevertheless, it will be understood that various modifications may be made without departing from the spirit and scope of the invention. Accordingly, other embodiments are within the scope of the following claims.

What is claimed is:

1. A method of manufacturing an ink stick, the ink stick being a consumable used in a printing process, the method comprising:

attaching a customer replaceable unit monitor (CRUM) including an electronically-readable memory device to the ink stick; and storing electronic data related to the ink stick in the memory device, wherein in said attaching step the CRUM is adhered to a surface of the ink stick or at least partially embedded in the ink stick.

2. The method of claim 1, further comprising:

positioning at least one contact pad on a surface of the ink stick, the at least one contact pad being electrically connected to the memory device.

3. The method of claim 1, wherein the memory device is a component of a radio frequency identification chip.

4. The method of claim 1, wherein the electronic data includes at least one of:

identification data, anti-arbitrage variables, usage data, maximum use values, and performance data related to the ink stick.

5. A method of manufacturing an ink stick, the ink stick being a consumable used in a printing process, the method comprising:

attaching a customer replaceable unit monitor (CRUM) including an electronically-readable memory device to the ink stick, wherein in said attaching step the CRUM is adhered to a surface of the ink stick or at least partially embedded in the ink stick, and the memory device has stored therein electronic data related to the ink stick.

6. The method of claim 5, further comprising:

positioning at least one contact pad on a surface of the ink stick, the at least one contact pad being electrically connected to the memory device.

7. The method of claim 5, wherein the memory device is a component of a radio frequency identification chip.

8. The method of claim 5, wherein the electronic data includes at least one of:

identification data, anti-arbitrage variables, usage data, maximum use values, and performance data related to the ink stick.

* * * * *